United States Patent [19]

Watanabe et al.

[11] Patent Number: 4,504,706

[45] Date of Patent: Mar. 12, 1985

[54] ROTARY PULSE SWITCH

[75] Inventors: Yuji Watanabe, Miyagi; Takeshi Yamashita, Furukawa, both of Japan

[73] Assignee: Alps Electric Co., Ltd., Tokyo, Japan

[21] Appl. No.: 540,820

[22] Filed: Oct. 11, 1983

[30] Foreign Application Priority Data

Oct. 8, 1982 [JP] Japan ..... 57-152145[U]

[51] Int. Cl.[3] ..... H01H 19/60

[52] U.S. Cl. ..... 200/11 R; 200/6 R; 200/11 G; 200/153 LB; 200/336

[58] Field of Search ..... 200/5 R, 6 R, 6 B, 6 BA, 200/6 BB, 6 C, 11 R, 11 G, 11 J, 11 K, 11 TW, 17 R, 153 L, 153 LB, 336

[56] References Cited

U.S. PATENT DOCUMENTS

| | | | |
|---|---|---|---|
| 3,958,087 | 5/1976 | Mol et al. | 200/17 R |
| 3,975,601 | 8/1976 | Whelan | 200/11 R |
| 4,087,665 | 5/1978 | Tanaka | 200/11 R X |
| 4,107,482 | 8/1978 | Marker | 200/11 R X |
| 4,145,585 | 3/1979 | Iwasaki | 200/11 G X |
| 4,282,415 | 8/1981 | Shimizu et al. | 200/336 |

*Primary Examiner*—J. R. Scott

*Attorney, Agent, or Firm*—Guy W. Shoup; Gerard F. Dunne

[57] ABSTRACT

A rotary pulse switch is disclosed in which contact pairs each consisting of a movable contact and a fixed contact are disposed along a radial face of the rotor so as to be closer to the center than the outer circumferential edge of the rotor. In this way, the width of a case into which the contact pairs fit can be made only slightly larger than the diameter of the rotor. A contact operating member for pushing a movable contact extends from the side of an operating member disposed in the proximity of the outer circumferential surface of the rotor between the two contact pairs and at substantially the same height as a projection of the operating member. Thus, the height of the case can also be reduced.

11 Claims, 12 Drawing Figures

ROTARY PULSE SWITCH

BACKGROUND OF THE INVENTION

This invention relates to a rotary pulse switch which activates one switch circuit when an operating shaft is rotated in one direction, and activates another switch circuit when the operating shaft is rotated in the other direction. More particularly, the present invention relates to such a rotary pulse switch of a reduced size.

Rotary pulse switches such as that shown in FIGS. 1 through 5 have been known, for example, as described in U.S. Pat. No. 4,282,415.

In such a switch, a case molded from synthetic resin is formed of two parts 1 and 2, and has a central operating shaft 3 supporting a rotor 4 having an oblong central hole 4*a* receiving the operating shaft for rotation therewith. Elongate movable contacts 5 and 7 extend along respective sides of the case and have their lower end portions held in the grooves 1*c* formed in case part 1 in parallel spaced relation to fixed contacts 6 and 8 held in respective grooves 1*c*. The upper free ends of the movable contacts 5 and 7 carry respective contact portions 5*a* and 7*a* facing the upper end portions of the fixed contacts 6 and 8.

An operating member 9 is held for laterally sliding movement within the switch by projections 1*b* formed on the case past 1, and a nodal leaf spring 10 is supported in the lower portion of the case part 2 by projections 2*b*. The operating shaft 3 carrying the rotor 4 for unitary rotation is supported within the central holes 1*a* and 2*a* in the case parts 1 and 2, respectively. The rotor 4 is molded from a synthetic resin and has a plurality of projections $4_1$, $4_2$, etc. positioned equidistantly around its circumference and projecting from both surfaces of the rotor in the direction parallel to the operating shafts.

End portions 9*a* and 9*b* of the operating member 9 substantially face the rear surfaces of contact portions 5*a*, 7*a* formed at the ends of the movable contacts 5 and 7. A central projection 9*c* of the operating member 9 is located at a position within the path of movement of the projections $4_1$, $4_2$, etc. as the rotor 4 is rotated.

In the rotary pulse switch of the kind described above, when the operating shaft 3 rotates in the direction of the arrow A in FIG. 4, the rotor 4 rotates with it and the projection $4_3$ of the rotor 4 moves in the direction of the arrow A so as to push the projection 9*c* of the operating member 9 leftwardly in the direction of the arrow B, so that the operating member 9 moves in the direction of the arrow B and the end portion 9*a* of the operating member 9 pushes the movable contact 5 into engagement with the fixed contact 6.

When the rotor 4 rotates further, the projection 9*c* is pushed upwardly by the projection $4_3$ due to the inherent resiliency of the operating member 9 so that the projection $4_3$ of the rotor 4 rides under the projection 9*c* and the projection 9*c* is positioned between the projections $4_3$ and $4_5$. At this time, the operating member 9 returns in the direction opposite to the arrow B because of the resiliency of the movable contact 5, thus disengage the movable contact 5 and the fixed contact 6. A projection 10*a* of the nodal leaf spring 10 engages with or disengages from the projections $4_2$, $4_4$, etc. on the rear surface of the rotor 4 simultaneously with the operation described above to provide a clear nodal contact. Although the above deals with a rotation to the left, rotation to the right can be carried out in exactly the same way to cause the contacts 7 and 8 to repetitively engage and disengage.

In the conventional rotary pulse switch of the type described above, however, a plurality of projections $4_1$, $4_2$, etc. are provided equidistantly around an oblong hole 4*a* at the center of the rotor 4 in such a manner so as to project from both surfaces of the rotor in a direction parallel to the operating shaft, and contact pairs consisting of movable contacts 5 and 7 and fixed contacts 6 and 8 are spaced from respective sides from the outer periphery of the rotor 4, so that they do not come into contact with the projections $4_1$, $4_2$ etc. For this reason, the width of the case 1 into which the movable and fixed contacts are fitted must be somewhat greater than the diameter of the rotor 4.

The end portions 9*a* and 9*b* of the operating member 9 disposed slidably between the two contact pairs are separated vertically from the projection 9*c* that moves into contact with the projections $4_1$, $4_3$, etc. of the rotor 4, so that the height of the case 1 supporting the operating member 9 must also be increased. Hence, the prior art device has the problem that the overall size of the switch can not be reduced easily.

SUMMARY OF THE INVENTION

The present invention is, therefore, directed to providing a rotary pulse switch in which the width of the case, into which contact pairs consisting of movable and fixed contacts are fitted, is only slightly larger than the diameter of the rotor and in which the height of the case is also reduced.

The present invention will become more apparent from the following description to be read in conjunction with the accompanying drawings.

DESCRIPTION OF THE PREFERRED EMBODIMENTS

Figure 1:
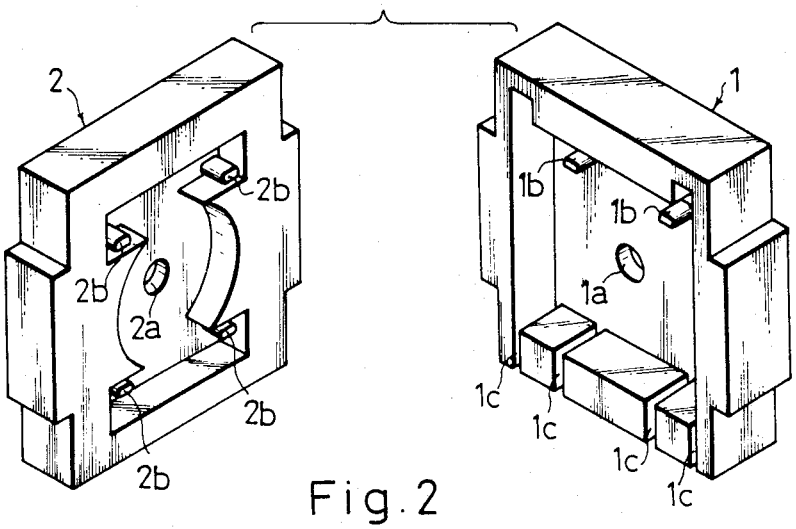
Fig.1 PRIOR ART
FIG. 1 is an exploded perspective view of portions of a conventional rotary pulse switch.
Figure 2:
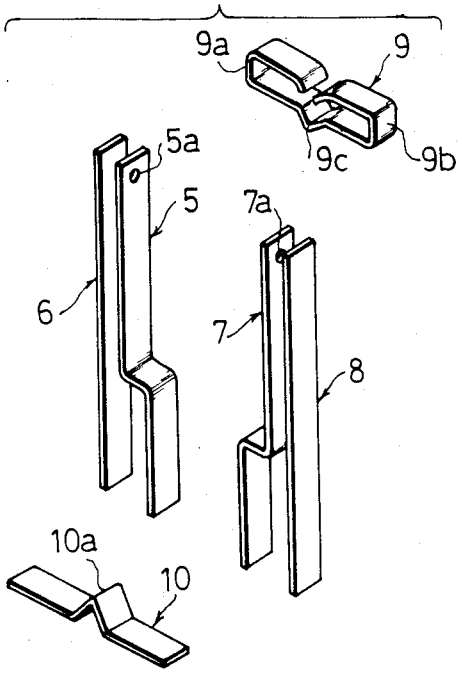
Fig.2 PRIOR ART
FIG. 2 is an exploded perspective view of the movable and fixed contacts, operating member and nodal member of the switch when disassembled.
Figure 3A:
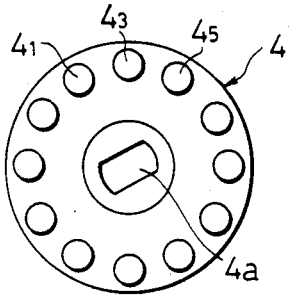
Fig. 3(A) PRIOR ART
FIGS. 3A and 3B are front and side views of the rotor of the rotary pulse switch.
Figure 3B:
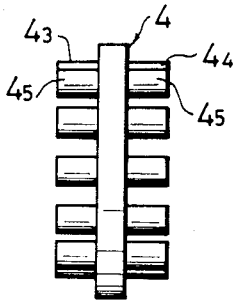
Fig. 3(B) PRIOR ART
Figure 4:
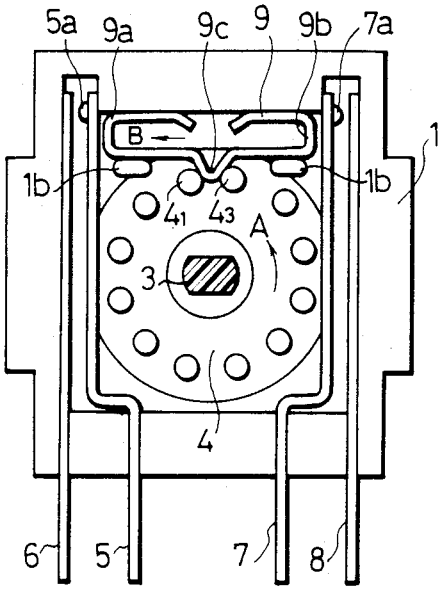
Fig. 4 PRIOR ART
FIG. 4 is a plan view of the principal parts with one of the cases removed, in order to illustrate the operation of the switch.
Figure 5:
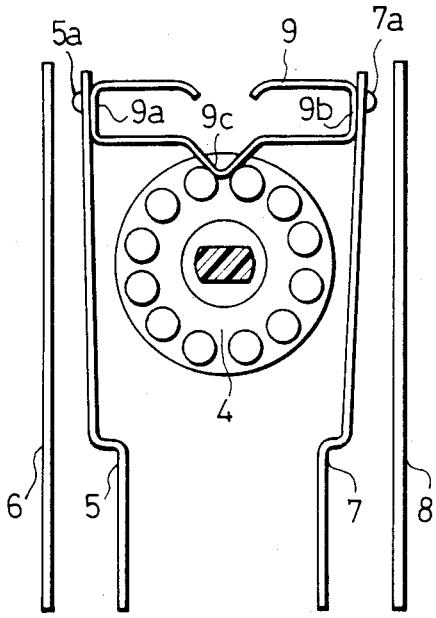
Fig. 5 PRIOR ART
FIG. 5 is a front view of the principal parts of the switch.
Figure 6:
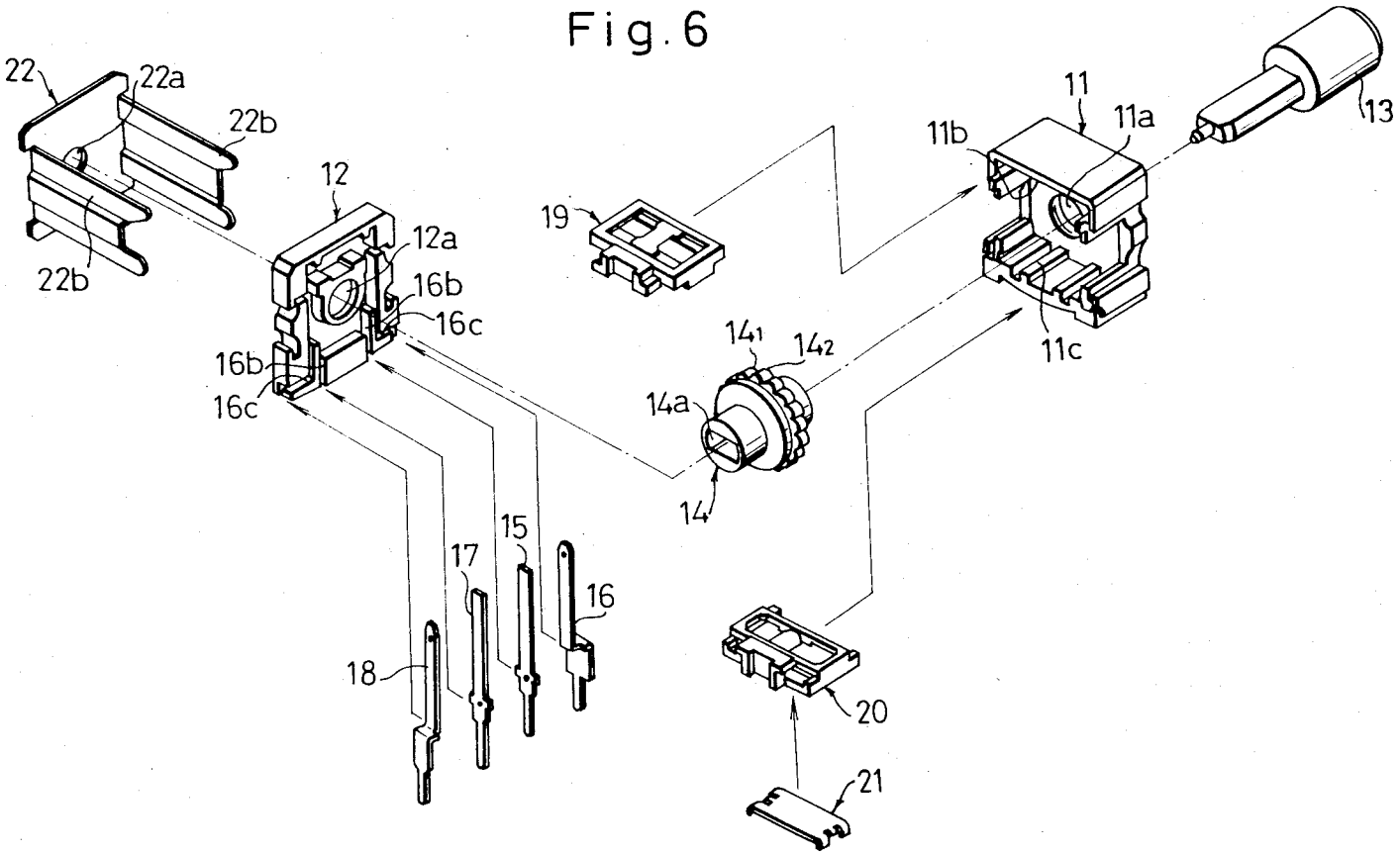
FIG. 6 is an exploded perspective view of the rotary pulse switch in accordance with one embodiment of the present invention.

The present invention will now be described with reference to the accompanying drawings.

FIGS. 6 through 11 illustrate one embodiment of the present invention, wherein a case is formed by casing parts 11 and 12 each molded from a synthetic resin material and having central holes 11*a* and 12*b* for rotatably supporting an operating shaft 13 carrying a rotor 14 for rotation unitarily herewith. Moveable contacts 15 and 17 formed by punching a metallic sheet are fitted within the casing part 12, as well as the fixed contacts 16 and 18 similarly formed from a metallic sheet. An operating member 19 and a nodal member 20 are respectively molded from a synthetic resin material.

An engagement portion 11*b* is provided in the top portion of the case 11 to support the operating member 19 for movement to the right and left. Another engagement portion 11*c* is provided in the base of the case 11, the nodal member 20 is fixed to this engagement portion 11*c*.

The rotor 14 is molded from a synthetic resin and is equipped with an oblong hole 14*a* in its center through which the operating shaft 13 passes and with which it engages. A plurality of projections $14_1$, $14_2$, etc. are provided equidistantly around the outer circumference of the rotor 14.

Figure 7:
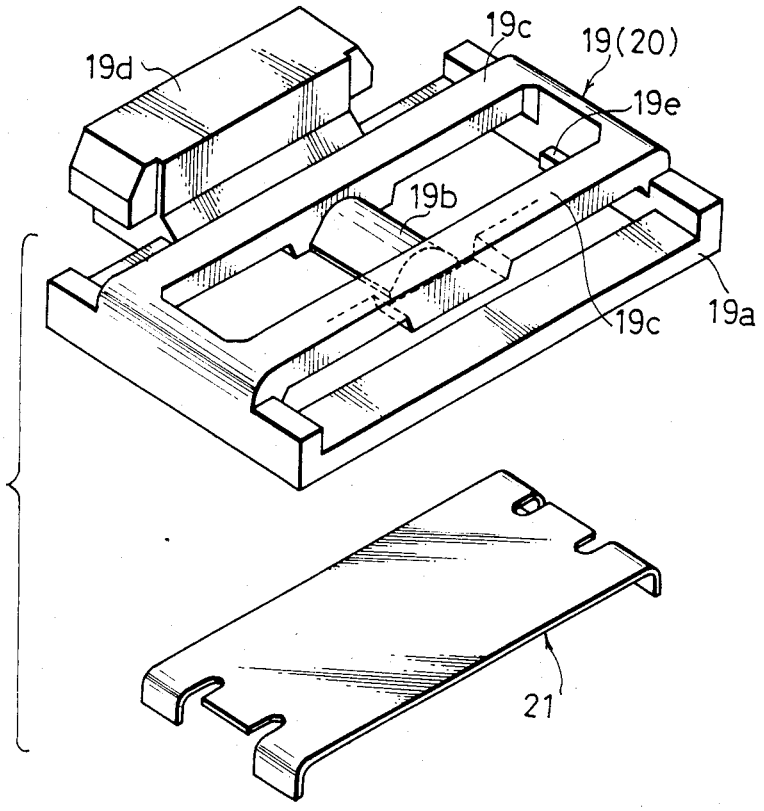
FIG. 7 is a perspective view of the operating member (nodal member) and leaf spring of the switch when disassembled.
Figure 8:
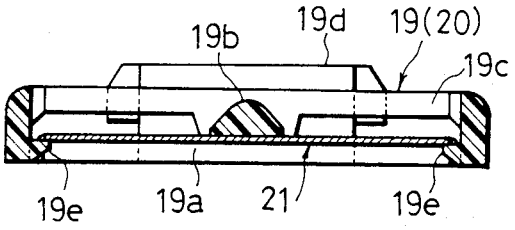
FIG. 8 is a section of the nodal member together with the leaf spring.

FIGS. 7 and 8 show the spring-like operating member 9, which consists of a rectangular frame member 19*a* having a projection 19*b* having a semicircular section. The projection 19*b* is supported centrally of the frame member 19*a* between flexible arm portions 19*c* extending in the longitudinal direction of the frame member 19*a*. A box-like contact operating member 19*d* extends laterally from the side of the frame plate 19*a*, and a support portion 19*e* is provided centrally at each end portion of the frame plate 19*a* for supporting the end portions of a leaf springs 21. Since the operating member 19 and the nodal member 20 have the same construction, details of the nodal member 20 are represented by the same reference numerals and further explanation of them is omitted. The leaf springs 21 are fitted into the support portions of the operating member 19 and the nodal member 20 so that they engage the flat surface of the projection 19*b*.

Engagement grooves 16*b* for the movable contacts and engagement grooves 16*c* for the fixed contacts are provided symmetrically on opposite sides of the hole 12*a* of the case 12 and the movable contacts 15, 17 and the fixed contacts 16, 18 are fitted into these movable contact engagement grooves 16*b* and the fixed contact engagement grooves 16*c*, respectively.

A fitting frame 22 includes a hole 22*a* for receiving the operating shaft 13 and side arms 22*b* for anchoring the cases 11 and 12.

The contact pairs each consisting of one of the movable contacts 15, 17 and one of the fixed contacts 16, 18 are positioned closer to the center of the switch than the outer circumferential edge of the rotor 14 on one side of the rotor, one contact pair on each side of the operating shaft. The operating member 19 is at a position close to the outer circumferential surface of the rotor 14 between the two contact pairs, and the projection 19*b* of the operating member 19 extends into the path of movement of the projections $14_1$, $14_2$, etc. of the rotor 14. The rear surfaces of contact portions 15*a*, 17*a* formed at the end of the movable contacts 15, 17 face the respective end portions of the contact operating member of the operating member 19.

The assembly of the rotary pulse switch in accordance with this embodiment will now be described.

First, the operating member 19 is supported movably by the engagement portion 11*b* of the case 11 and the nodal member 20 is fixed into the engagement portion 11*c*. After the operating shaft 13 is inserted through the hole 11*a* in the case 11, the rotor 14 is fitted onto the operating shaft 13. The rotor 14 is fitted onto the operating shaft 13. The rotor 4 is then placed inside the case 11 so that the projection 19*b* of the operating member 19 is between the projections $14_1$ and $14_2$ of the rotor 14, as shown in FIG. 9.

The movable contact plates 15, 17 and the fixed contact plates 16, 18 are inserted into and anchored to the movable contact engagement grooves 16*b* and the fixed contact engagement grooves 16*c* in the case 12, respectively. The case 12 is then positioned against the case 11 and the operating shaft 13 is inserted into the hole 12*a* of the case 12. The cases 11 and 12 are held together and the ends of engagement arms 22*b* of a fitting frame 22 that fit around the case 12 are bent and anchored to the case 11, thereby connecting the case 12 to the case 11 and completing the assembly of the rotary pulse switch.

Next, the operation of the rotary pulse switch will be described.

Figure 9:
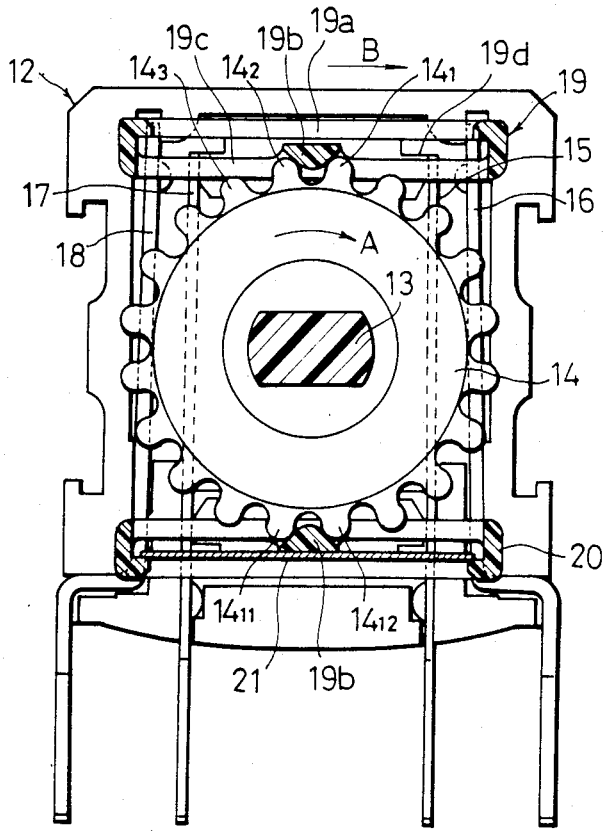
FIGS. 9 and 10 are plan views of the principal parts with one of the cases removed in order to illustrate the operation of the switch.
Figure 10:
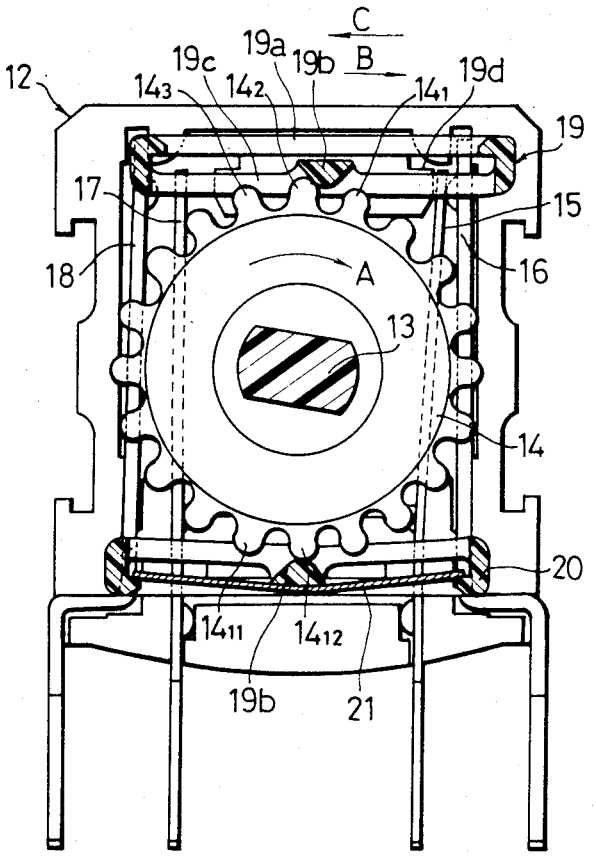
Figure 11:
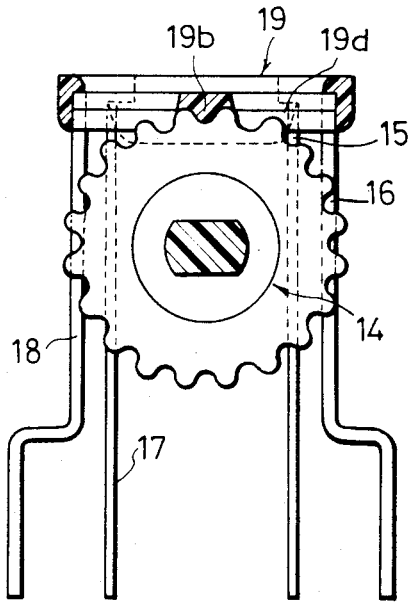
FIG. 11 is a plan view of the principal parts of the switch.

When the operating shaft 13 rotates in the direction of the arrow A in FIGS. 9 and 10, the rotor 14 also rotates and the projection $14_2$ of the rotor 14 moves in the direction of the arrow A. In this case, it pushes the projection 19*b* of the operating member 19 that is positioned between the projection $14_2$ and the adjacent projection $14_1$ in the direction of the arrow B. Accordingly, the operating member 19 moves in the direction of the arrow B and the right end portion of the contact operating member 19*d* pushes the movable contact 17 into contact with the fixed contact 16.

When the rotor 14 rotates further, the projection 19*b* is pushed upwardly by the projection $14_2$ against the resiliency of the arm 19*c* of the operating member 19, as shown in FIG. 9, and the projection $14_2$ moves over the projection 19*b* and comes between the projections $14_2$ and $14_3$. Because of the resiliency of the movable contact 15, the operating member 19 returns in the direction of the arrow C and the contact between the movable contact 15 and the fixed contact 16 is broken. Simultaneously with the operation described above, the projection 19*b* of the nodal member 20 below the rotor 14, that is, at a position opposite to the operation member 19, disengages from the projections $14_{11}$ and $14_{12}$ of the rotor 14 due to the resiliency of the arm 19*c* and the leaf spring 12, thus providing a clear nodal contact.

Although the above explains the rotation of the rotor 14 to the right, activation of the switch by rotation of the rotor to the left can be carried out in exactly the same way.

In this embodiment, the contact operating member 19*d* extends horizontally from the side of the frame plate 19*b*, but it can of course extend at an angle from the side of the frame plate 19*a* towards the operating shaft 13.

As described above, in accordance with the present invention, each contact pair consisting of a fixed contact and a movable contact is positioned closer to the center than at least the outer circumferential edge of a rotor on either side of an operating shaft for the rotor. According to this construction, the width of the case into which the contact pairs are fitted needs to be only slightly larger than the diameter of the rotor, and problems with the prior art device can thus be eliminated.

A contact operating member for pushing the movable contacts extends laterally from the side of an operating member which is closer to the outer circumferential surface of the rotor; hence, the contact operating member is situated at a position substantially the same in height as a projection of an operating member, and the height of the case can be thus reduced in comparison with the prior art device in which the edge portion of an operating member for pushing the movable contacts is separated vertically from the projection coming into contact with the projections of the rotor. For these reasons, the overall size of the switch can be reduced.

What is claimed is:

1. A rotary pulse switch comprising:

a case;

an operating shaft extending through said case and supported rotatably by said case;

a rotor having a plurality of projections disposed equidistantly on the outer circumferential surface;

contact pairs, each consisting of a fixed contact and a movable contact, positioned closer to the center than at least the outer circumferential edge of said rotor with said operation shaft between said contact pairs;

an operating member disposed between said contact pairs and capable of sliding movement to a position closer to the outer circumferential surface of said rotor;

a contact operating member extending from the side of said operating member; and a projection provided so as to project from the center of said operating member and able to engage with and disengage from said projections of said rotor;

said movable contacts being positioned at either end of said contact operating member so as to face each other;

said contact operating member pushing one of said movable contacts and bringing it into contact with the corresponding fixed contact when said operating member is moved in accordance with the rotation of said rotor through a desired angle and thereafter returning by the resilient force of the movable contact.

2. The rotary pulse switch as defined in claim 1 wherein said operating member is resilient.

3. The rotary pulse switch as defined in claim 1 wherein said operating member consists of a frame member and resilient arm portions to support said projection.

4. A rotary pulse switch comprising:

a case;

an operating shaft extending through said case and supported rotatably by said case;

a rotor having a plurality of projections disposed equidistantly on the outer circumferential surface thereof;

contact pairs, each consisting of a fixed contact and a movable contact, positioned closer to the center than at least the outer circumferential edge of said rotor on one side of said rotor with said operating shaft between said contact pairs;

a nodal member fixed in the lower portion of said case, and having a projection capable of engaging with and disengaging from said projections of said rotor;

an operating member provided in the upper portion of said case and between said contact pairs, said operating member being capable of sliding movement to a position closer to the outer circumferential surface of said rotor;

a contact operating member extending from the side of said operating member; and a projection provided so as to project from the center of said operating member and be able to engage with and disengage from said projections of said rotor;

said moving contacts being positioned at either end of said contact operating member so as to face each other;

said contact operating member pushing one of said movable contacts and bringing it into contact with the corresponding fixed contact, thereby providing a clear nodal contact, when said operating member is moved in accordance with the rotation of said rotor through a desired angle and thereafter returning by the resilient force of the movable contact.

5. The rotary pulse switch as defined in claim 4 wherein said operating member is resilient.

6. The rotary pulse switch as defined in claim 4 wherein said operating member consists of a frame member and resilient arm portions to support said projection.

7. The rotary pulse switch as defined in claim 4 wherein said nodal member is resilient.

8. The rotary pulse switch as defined in claim 4 wherein said nodal member consists of a frame plate and resilient arm portions to support said projection.

9. The rotary pulse switch as defined in claim 4 wherein said nodal member has a projection of a spring member coming into contact with the bottom surface of said projection.

10. A rotary pulse switch for actuating one switch circuit during rotation of an operation shaft in one direction and another switch circuit by rotation of the operation shaft in the other direction; said switch including a central rotor having a plurality of radial projections spaced equidistantly around the circumference thereof, each said switch circuit including a respective pair of contacts lying along a radial face of said rotor on opposing sides of the operation shaft, and means including an operation member having a central projection extending into the path of movement of said radial projections during rotation of said rotor and a contact-pushing member extending axially of said operation shaft for urging either pair of contacts resiliently into engagement as said rotor is rotated to bear a radial projection against said central projection to slide said operation member in the direction of movement of said radial projection, said central projection being biased resiliently into said path of movement so as to slide over the passing radial projection during continued rotation of said rotor to enable said operation member to be returned by the resilience of the engaged contact pair.

11. A rotary pulse switch according to claim 10, including a nodal member fixed in position oppositely accross said rotor from said operation member and having a central projection extending resiliently into the path of movement of said radial projections.

* * * * *